United States Patent [19]

Phelps

[11] Patent Number: 4,779,830

[45] Date of Patent: Oct. 25, 1988

[54] SUPPORT SYSTEM

[75] Inventor: Laurence G. Phelps, Sutton, England

[73] Assignee: Snap Lock Shelving Co. Ltd., Arundel, England

[21] Appl. No.: 49,735

[22] Filed: May 13, 1987

[51] Int. Cl.[4] ..... A47G 29/02

[52] U.S. Cl. ..... 248/250; 211/90; 211/187; 211/193; 248/235; 248/243; 29/453

[58] Field of Search ..... 248/243, 250, 245, 246, 248/247, 235; 211/193, 187, 90; 108/108; 29/453

[56] References Cited

U.S. PATENT DOCUMENTS

| | | | |
|---|---|---|---|
| 1,939,408 | 12/1933 | Parker | 248/250 |
| 3,158,349 | 11/1964 | Bergstrom | 248/243 |
| 3,207,100 | 9/1965 | Peacock | 248/250 X |
| 3,848,844 | 11/1974 | Barrett | 248/245 |
| 4,103,855 | 8/1978 | Grosse | 248/248 |
| 4,156,515 | 5/1979 | Mochly | 248/246 |
| 4,211,379 | 7/1980 | Morgan et al. | 248/243 X |
| 4,299,368 | 11/1981 | Winkler | 108/108 X |
| 4,674,723 | 6/1987 | Bayuk | 248/247 X |
| 4,691,887 | 9/1987 | Bessinger | 211/90 X |
| 4,720,069 | 1/1988 | Bessinger | 211/90 X |

FOREIGN PATENT DOCUMENTS

| | | | |
|---|---|---|---|
| WO83/03743 | 11/1983 | PCT Int'l Appl. . | |
| 0346430 | 6/1960 | Switzerland | 248/245 |

*Primary Examiner*—Ramon O. Ramirez
*Attorney, Agent, or Firm*—Connolly & Hutz

[57] ABSTRACT

A shelf support system comprises a bracket member which is snapped into a vertical channel by means of a head portion which has asymmetrical recesses which co-act with asymmetrical jaws of the channel. One recess is placed over one of the jaws which then serves as a pivot while the other recess snaps over the other jaw. To assist in retaining a shelf on the bracket member, an integral spike is provided.

8 Claims, 2 Drawing Sheets

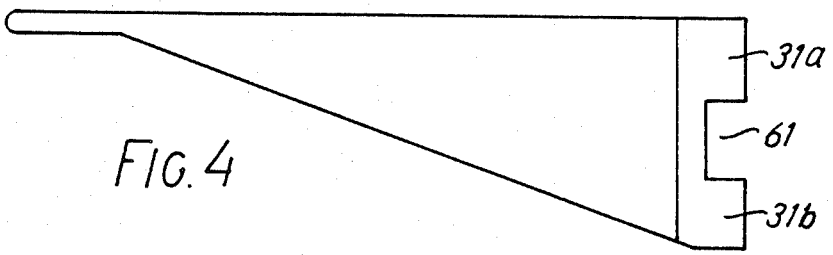
FIG. 4
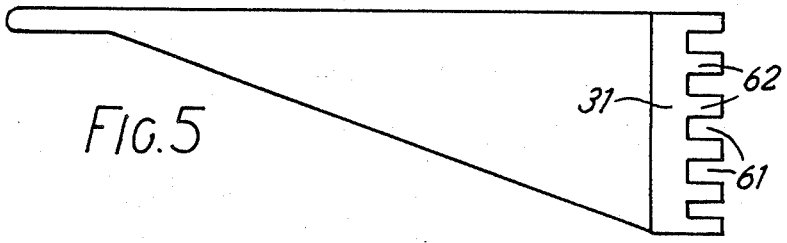
FIG. 5
FIG. 6
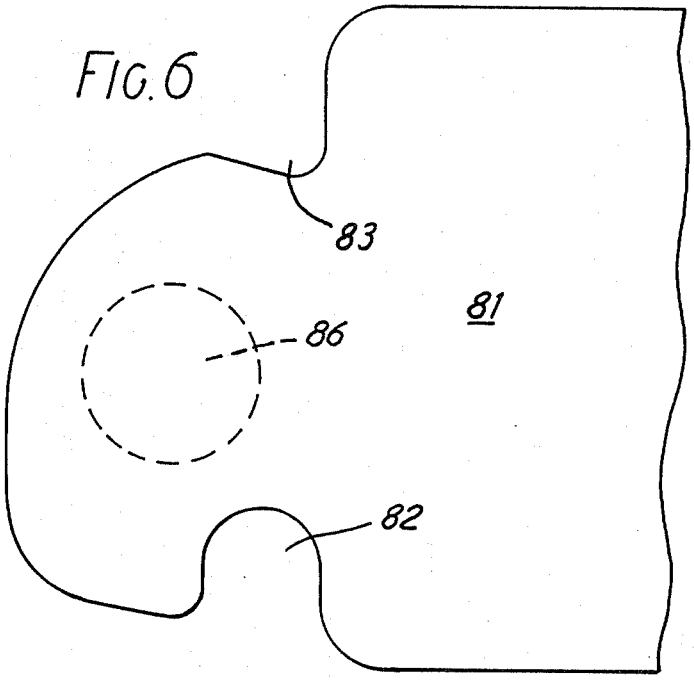

SUPPORT SYSTEM

BACKGROUND OF THE INVENTION

The present invention relates to a support system and more particularly to a shelf support system, in which individual bracket members are attached to a channel member fixed to wall.

In existing systems, a relatively complicated procedure is necessary to insert the bracket members in the channel member. In addition the bracket members are frequently loosely mounted in the panel member so that relative movement between the two can occur. In particular, rotational movements of the bracket member can occur in horizontal and vertical planes.

One particular disadvantage of many existing systems is that the backet members can only be fixed to the channel member at certain discrete points. In U.S. Pat. No. 3,848,844, there is disclosed a shelf system which overcomes this disadvantage in that the bracket members can be slid along the channel member to any desired height. However, a relatively complicated and time-consuming procedure is then necessary to secure the bracket member to said height, i.e. the insertion of a separate friction inducing element. Another disadvantage is that the bracket members can only be inserted into the channel member at the ends thereof; thus to add an extra bracket member to an existing shelf support system may necessitate the dismantling of the existing shelves followed by re-assembly.

SUMMARY OF THE INVENTION

The present invention seeks to overcome or reduce one or more of the above problems.

According to a first aspect, the present invention provides a support system comprising a support member arranged to be attached to a channel member, said channel member being arranged to be fixed to a wall and being substantially U-shaped with a web portion and two arms with inwardly-facing jaw portions at the free ends of said arms, and said support member comprising attachment means having two recesses at opposite sides thereof and arranged to co-operate with said jaw portions, the width of said attachment means measured between said recesses being greater than the separation of said jaw portions of the channel member when unstressed.

According to a second aspect, the invention provides a method of assembling the above support system wherein one of said recesses is placed over one of said jaw portions, said one jaw portion thereafter serving as a pivot while the other is snapped over the other of said jaw portions.

BRIEF DESCRIPTION OF THE DRAWINGS

A preferred embodiment of the present invention will now be described, by way of example only, with reference to the accompanying drawings, of which:

FIGS. 4 and 5 are side views of modified bracket members; and

FIG. 6 is an enlarged top plan view of the head portion of a modified bracket member.

DESCRIPTION OF THE PREFERRED EMBODIMENTS

Figure 1:
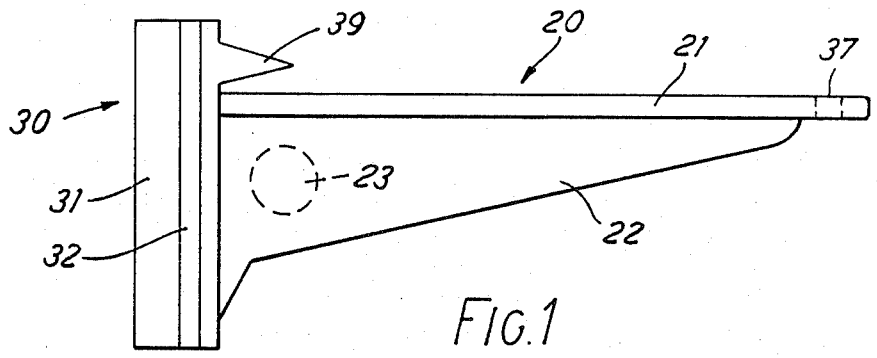
FIG. 1 is a side view of a bracket member of a shelf support system in accordance with the present invention.

Basically the present invention provides a support system comprising a support member arranged to be attached to a channel member, the channel member being arranged to be fixed to a wall and being substantially U-shaped with inwardly-facing jaw portions at the free ends of the U-arms, and the support member comprising, at one end, attachment means having two recesses at opposite sides thereof and arranged to co-operate with the jaw portions, the width of the attachment means measured between the bases of the recesses being greater than the separation of the unstressed jaw portions of the channel member.

The present invention also provides a method of assembling a support system as set out in the previous paragraph wherein one of the recesses is placed over one of the jaw portions which thereafter serves as a pivot whilst the other recess is snapped over the other jaw portion.

Referring to the drawings a shelf support system comprises a plurality of U-shaped metal channel members 10 which are arranged to be screwed to a wall in a vertical configuration, and a plurality of metal bracket members 20 which are arranged to be attached to the members 10 at desired positions to support a shelf.

Each bracket member 20 comprises a generally triangular portion 22 and a generally planar portion 21 arranged, in use, to support the bottom of a shelf. Member 20 has attachment means 30 at one end for attaching it to the channel member 10. The attachment means comprises a head portion 31, which is arranged to enter the channel member 10, with side recesses 32, 33 and flanges 34, 35. Each recess comprises two edges, a first edge formed by the straight edge of the respective flange and a second edge. The second edge of recess 32 is concave, whereas the second edge of recess 33 is straight.

Space from portion 21 and parallel thereto, a steel pin 39 projects from head portion 31. At the end remote from the head portion 31, the planar portion 21 has a through screw hole 37.

Figure 2:
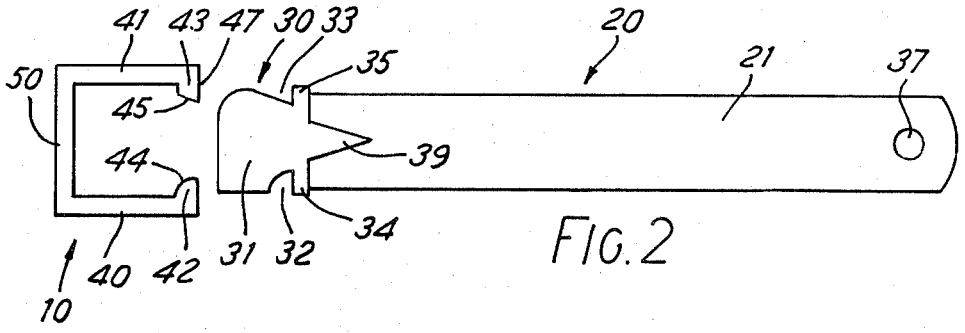
FIG. 2 is a top plan view of a shelf support system incorporating the bracket member of FIG. 1 before assembly.

The channel member 10 has inwardly-directed jaw portions 42, 43 at the free ends of U-arms 40, 41. The rear face 44 of jaw portion 42 is convex with substantially the same radius of curvature as the concave edge of recess 32. The inner face 45 of jaw portion 43 is straight and the angle formed between face 45 and front face 47 is substantially the same as that formed between the straight edges of recess 33. The separation of the two jaw portions 42 and 43 when the channel member 10 is unstressed (i.e. as in FIG. 2) is arranged to be slightly less than the separation of the bases of the recesses 32 and 33.

To mount the bracket member 20 on to channel member 10, recess 32 is first placed over jaw portion 42. Jaw portion 42 is then used as a pivot as the bracket member 20 is rotated (anticlockwise in FIGS. 2 and 3) the head portion 31 is squeezed past jaw portion 43 to snap into position in the channel member. During this operation the jaw portions are forced apart and finally move together again as jaw portion 43 enters recess 33. Since the separation of the recesses 32, 33 is slightly greater than the unstressed separation of jaw portions 42, 43, the latter are still stressed and exert a tight frictional grip on the attachment means.

A wooden shelf (not shown) is then placed on planar portion 21 and its rear edge is pierced by pin 39 to lock the shelf and bracket member together. The front of the shelf is then attached to the planar portion by means of a screw passing through hole 37.

To remove the bracket member 20 from the channel member it is rotated clockwise around jaw portion 42 as a pivot to snap it out.

Figure 3:
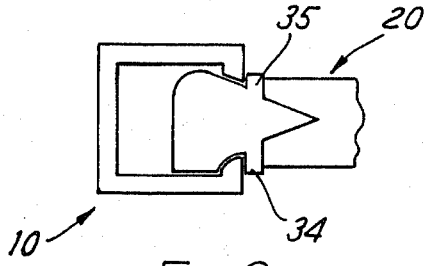
FIG. 3 is a part view similar to FIG. 2, but after assembly.

The above-described system permits the bracket member to be quickly, simply and securely attached to the channel member. The secure, frictional, metal-to-metal grip of the jaw portions on the attachment means ensures that no rotation of the bracket member can occur in the horizontal plane. Furthermore, the front and rear surfaces of recess 32 exert a tight grip on the front and rear of jaw portion 42 so that rotation in a vertical plane is also prevented. It should be noted in this respect that FIG. 3 is purely schematic and that in practice there are no gaps between the jaw portions and their respective recesses.

The provision of pin or spike 39 consists in the quick assembly of the shelf support system since the need for a plurality of drilling and screwing operations is avoided.

The bracket member may be attached to the channel member at any desired position therealong. In addition mounting of the bracket member is effected from the front of the channel member. Thus the need to insert each bracket member from an end of the channel member is avoided; indeed the bracket members of the present invention do not slidealong the channel member at all.

Various modifications may be made to the above-described system. For example, the shapes of recesses 32, 33 and jaw portions 42, 43 are not restricted to those shown and described and a wide range of cross-sections may be employed, including symmetrical ones. For many applications pin 39 is capable by itself of holding a shelf in position, so that screw hole 37 can be omitted. Pin 39 may project vertically from section 31 instead of horizontally and two or more pins 39 may be provided. Alternatively pin 39 can be omitted and further screw holes provided if desired. Although the system described comprises metal members, the components may be alternatively of plastics material.

Triangular portion 22 may extend along the centre line of portion 21; in this case any screw holes through portion 21 in this region are staggered to one side of the centre line. Alternatively the triangular portion is shifted towards one longitudinal edge of the portion 21, thus permitting the screw holes to be arranged centrally thereof, like screw hole 37.

The triangular portion 22 may have a through hole 23 therein. With a plastics bracket member 20 this has the advantage that, after mounting the bracket member on to channel member 10, a finger may be inserted in the hole 23 to press the bracket member towards the left in the Figures. This spreads the material of head portion 31 to provide a better grip.

Another modification which serves to improve the frictional grip of the head portion 31 is shown in FIG. 4. Although head portion 31 still has the same general cross section in a horizontal plane it comprises two vertically-spaced parts 31a and 31b separated by centrally-arranged cut-out 61. More than one cut-out or slot 61 may be provided, as shown in FIG. 5, where the head portion has a plurality of vertically-spaced ribs 62. The modifications of FIGS. 4 and 5 have the further advantages of saving material and making the bracket member lighter.

FIG. 6 shows the head portion 81 of a modified bracket member on an enlarged scale. Preferred dimensions are indicated thereon in millimeters. A preferred material of the bracket member is 30% glass-filled nylon.

The head portion has side recesses 82, 83 which are arranged to engage with the jaws 42, 43. As shown, recess 82 is generally semi-circular, whereas recess 83 is generally triangular with a curved apex. The assembly of the bracket member 81 to the channel member 50 is similar to that described in connection with FIGS. 1 to 3. To prevent unwanted warping of the head portion, a circular hole 86 may be provided extending from the top to the bottom thereof. This has the additional advantages of enabling a better grip to be obtained and saving material.

The circular hole 86 has a further purpose in that after shelf has been positioned on the bracket member, a first arm of a right-angled peg may be tapped into the hole. Insertion continues until the second arm of the peg engages the top surface of the rear of the shelf to hold it in position. This avoids the need for a spike 39. The first arm of the peg may be configured like the head portion 31 of bracket member 20; however, the peg is of relatively soft material so that it can be relatively easily inserted into a channel member 10 from the front and then slid down the channel member to engage the top of a shelf. Most of the peg is hidden from view by the shelf.

It will be understood that the above description of the present invention is susceptible to various modifications, changes and adaptations.

I claim:

1. A support system comprising a support member arranged to be attached to a channel member, said channel member being arranged to be fixed to a wall and being substantially U-shaped with a web portion and two arms with inwardly-facing jaw portions at the free ends of said arms, and said support member comprising attachment means having two recesses at opposite sides thereof and arranged to cooperate with said jaw portions, the width of said attachment means measured between said recesses being greater than the separation of said jaw portions of the channel member when unstressed, a portion of said attachment means is arranged to extend into said channel member and said arms of said channel member are longer than said attachment means portion, whereby in use said attachment means portion is spaced from said web portion of said channel member.

2. A support system according to claim 1, wherein said jaw portions are asymmetric.

3. A support system according to claim 1, wherein said recesses are asymmetric.

4. A support system according to claim 1, wherein said web portion of said channel member is wider than said attachment means portion, whereby, in use, said attachment means is located spaced from said arms of said channel member.

5. A support system comprising a support member arranged to be attached to a channel member, said channel member being arranged to be fixed to a wall and being substantially U-shaped with a web portion and two arms, with inwardly-facing jaw portions at the free ends of said arms, and said support member comprising attachment means having two recesses at opposite sides thereof and arranged to cooperate with said jaw portions, the width of said attachment means measured between said recesses being greater than the separation of said jaw portions of the channel member when unstressed, wherein said support member comprises a bracket arm extending from said atachment means and arranged to support a shelf thereon, and a spike is provided adjacent to said bracket arm for penetrating the material of a shelf supported on said bracket arm, said spike extending parallel to said bracket arm.

6. A support system according to claim 5, wherein said spike is arranged to pierce the material of said shelf, thereby creating its own hole in said shelf.

7. A method of assembling a support system comprising a support member arranged to be attached to a channel member, said channel member being arranged to be fixed to a wall and being substantially U-shaped with a web portion and two arms with inwardly-facing jaw portions at the free ends of said arms, and said support member comprising attachment means having two recesses at opposite sides thereof and arranged to cooperate with said jaw portions, the width of said attachment means measured between said recesses being greater than the separation of said jaw portions of the channel member when unstressed, in which method one of said recesses is placed over one of said jaw portions, said one jaw portion thereafter serving as a pivot while the other recess is snapped over the other of said jaw portions.

8. A method of assembling a support system comprising a support member arranged to be attached to a channel member, said channel member being arranged to be fixed to a wall and being substantially U-shaped with a web portion and two arms with inwardly-facing jaw portions at the free ends of said arms, and said support member comprising attachment means having two recesses at opposite sides thereof and arranged to co-operate with said jaw portions, the width of said attachment means measured between said recesses being greater than the separation of said jaw portions of the channel member when unstressed, wherein the method comprises the steps of placing a first of said recesses over a first of said jaw portions and, using said first jaw portion as a pivot, rotating said support member in a plane substantially perpendicular to said channel member until the second said recess snaps over the second jaw portion, thereby attaching said support member to said channel member.

* * * * *